US007979956B2

(12) United States Patent
Matter et al.

(10) Patent No.: US 7,979,956 B2
(45) Date of Patent: Jul. 19, 2011

(54) VACUUM BAG ATTACHMENT DEVICE AND METHOD

(75) Inventors: Ralph Matter, Turbenthal (CH); Christoph Scheiwiller, Kirchberg SG (CH); Detlelf Auerswald, Horgenzell (DE)

(73) Assignee: Diversey, Inc., Sturtevant, WI (US)

( * ) Notice: Subject to any disclaimer, the term of this patent is extended or adjusted under 35 U.S.C. 154(b) by 293 days.

(21) Appl. No.: 12/161,917

(22) PCT Filed: Jan. 25, 2007

(86) PCT No.: PCT/US2007/061028

§ 371 (c)(1),
(2), (4) Date: Jul. 23, 2008

(87) PCT Pub. No.: WO2007/087591

PCT Pub. Date: Aug. 7, 2007

(65) Prior Publication Data

US 2009/0217481 A1 Sep. 3, 2009

Related U.S. Application Data

(60) Provisional application No. 60/761,942, filed on Jan. 25, 2006.

(51) Int. Cl.
*A47L 9/14* (2006.01)

(52) U.S. Cl. ..... 15/347; 15/DIG. 8; 55/373; 55/376; 55/377; 55/DIG. 2

(58) Field of Classification Search ..... 15/347, 15/DIG. 8; 55/373, 376, 377, DIG. 2; *A47L 9/14*
See application file for complete search history.

(56) References Cited

U.S. PATENT DOCUMENTS 4,948,266 A 8/1990 Bencic

FOREIGN PATENT DOCUMENTS

| | | |
|---|---|---|
| DE | 8427471 | 12/1984 |
| DE | 8532587 | 3/1987 |
| DE | 9321543 | 6/1999 |
| DE | 202005015042 | 2/2007 |
| EP | 1252853 | 10/2002 |
| EP | 1607034 | 12/2005 |
| WO | 0224047 | 3/2002 |

OTHER PUBLICATIONS

The International Search Report from the European Patent Office.

*Primary Examiner* — David A Redding
(74) *Attorney, Agent, or Firm* — Gregory S. Bollis

(57) ABSTRACT

A vacuum bag (10) attachment device and method. One embodiment provides a device for attaching a vacuum bag to a suction port of a vacuum cleaner (11), wherein the vacuum cleaner has a fixation projection (22) positioned adjacent the suction port (17). The attachment device comprises a holding plate (12) having a first aperture (15) configured and adapted to be received on the suction port of the vacuum. The holding plate also has a hinged portion (18) with a second aperture (21) positioned within the hinged portion. The hinged portion is moveable between a first position in which the hinged portion does not secure the holding plate to the vacuum and a second position in which the hinged portion secures the holding plate to the vacuum. The second aperture is configured and dimensioned to be received on the projection (22) adjacent the suction port of the vacuum cleaner when the hinged portion is in the second position.

3 Claims, 9 Drawing Sheets

VACUUM BAG ATTACHMENT DEVICE AND METHOD

BACKGROUND OF THE INVENTION

Many vacuum cleaners are equipped with a bag for storing waste material collected by the vacuum. Accordingly, vacuum bags within a vacuum cleaner need to be changed or emptied periodically.

Attachment of the bag to the interior of the vacuum cleaner is generally effected with the aid of attachment device. The attachment device in some conventional embodiments includes a rigid or semi-rigid part that is coupled to the bag. In general, the rigid part has a substantially central opening, which permits introduction of the suction tube or port. By placing the suction port into the opening of the attachment device, a seal between the interior of the bag and the suction tube is created.

Conventionally, the attachment device is held is place many different ways. In some embodiments, a friction fit between the opening and the suction port secures the attachment device to the suction port. In other embodiments, more complicated systems with many moving parts can automatically position the bag and attach it.

SUMMARY OF THE INVENTION

The present invention relates to an apparatus and method of attaching a vacuum bag to a vacuum cleaner. The vacuum bag attachment device of present invention comprises a holding plate or flange member having an opening wherein the suction port of the vacuum cleaner can be received within the opening. The flange member includes a hinged or articulated portion having apertures. Projecting members positioned adjacent the suction port can be received within the apertures to secure the vacuum bag to the suction port.

Some embodiments of the present invention relate to a vacuum bag attachment device for attaching a vacuum bag to a suction port of a vacuum cleaner, wherein the vacuum cleaner has a fixation projection positioned adjacent the suction port. The vacuum bag attachment device comprises a holding plate having a first aperture configured and adapted to be received on the suction port of the vacuum cleaner. The holding plate also has a hinged portion with a second aperture positioned within the hinged portion. The second aperture is configured and dimensioned to be received on the projection adjacent the suction port of the vacuum cleaner when the hinged portion is positioned substantially normal to the remainder of the holding plate.

Some embodiments relate to a vacuuming device. The vacuuming device includes a housing defining a chamber, an opening extending through the housing, and a conduit extending from the opening and into the chamber. A projection is positioned adjacent the conduit and extends in a substantially normal direction relative to the direction of extension of the conduit. The vacuuming device also includes a vacuum bag adapted to be received within the chamber and coupled to the conduit. The vacuum bag has an attachment device for connecting the vacuum bag to the conduit. The attachment device has a flange member or holding plate including a first aperture configured and adapted to be received on the conduit. The flange member has a hinged portion with a second aperture positioned within the hinged portion. The second aperture is configured and dimensioned to be received on the projection adjacent the conduit of the vacuum cleaner.

Yet other embodiments are directed toward a method of attaching a vacuum bag to a vacuum cleaner. The method can include the following steps. A vacuum cleaner having a suction port with a fixation projection positioned adjacent the suction port is provided. A vacuum bag having an attachment device for connecting the vacuum bag to the suction port is also provided. The attachment device has a holding plate including a first aperture configured and adapted to be received on the suction port. The holding plate also has a hinged portion with a second aperture positioned within the hinged portion. The second aperture is configured and dimensioned to be received on a projection adjacent the suction port of the vacuum cleaner. The first aperture is aligned with the suction port, and the first aperture is placed around the suction port. The hinged portion of the holding plate is folded toward the suction port, and the second aperture on the hinged portion is placed around a projection adjacent the suction port.

Further aspects of the present invention, together with the organization and operation thereof will become apparent from the following detailed description of the invention when taken in conjunction with the accompanying drawings.

DETAILED DESCRIPTION

Figure 1:
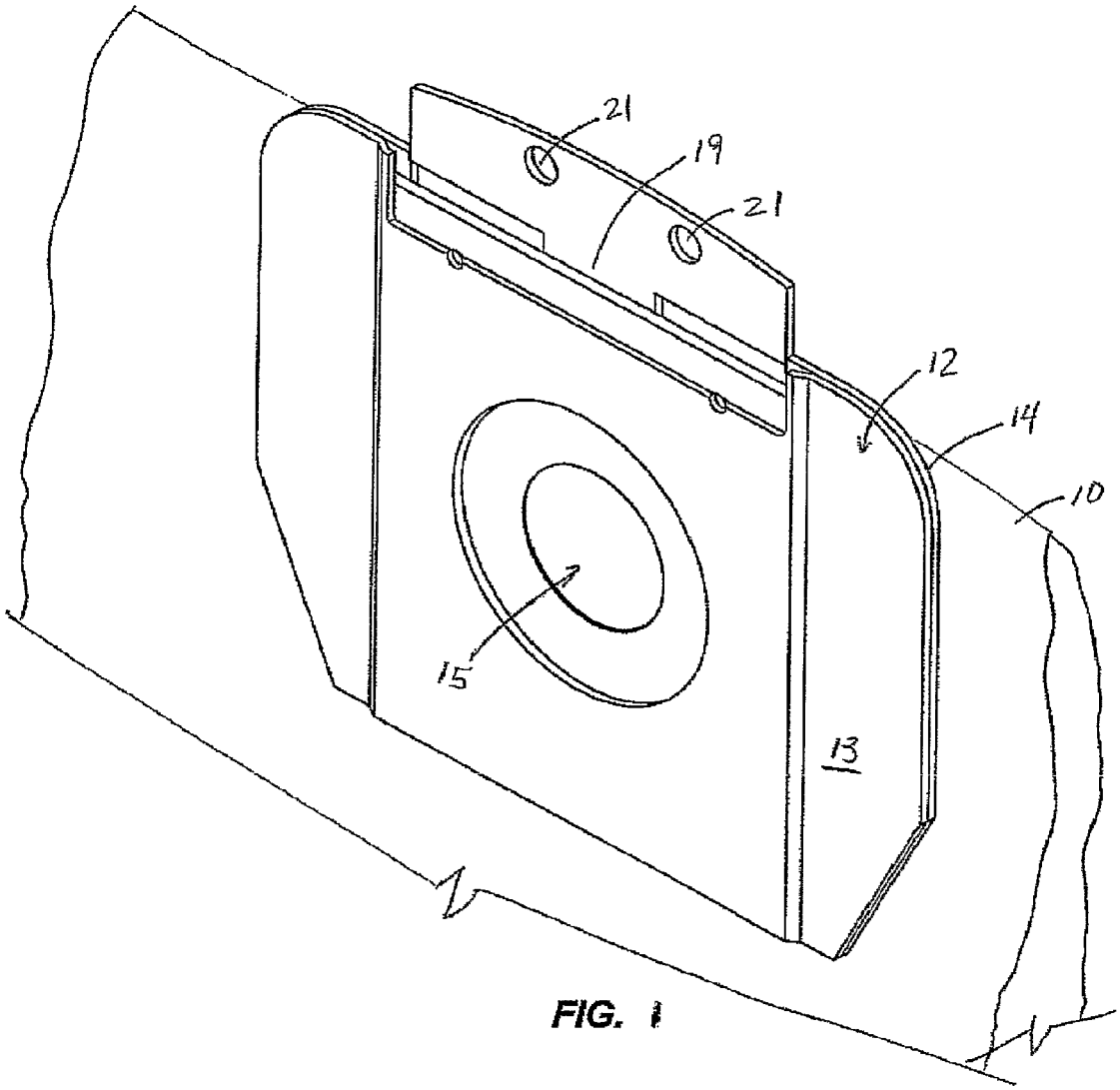
FIG. 1 is a front perspective view of a vacuum bag attachment embodying aspects of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

Figure 2:
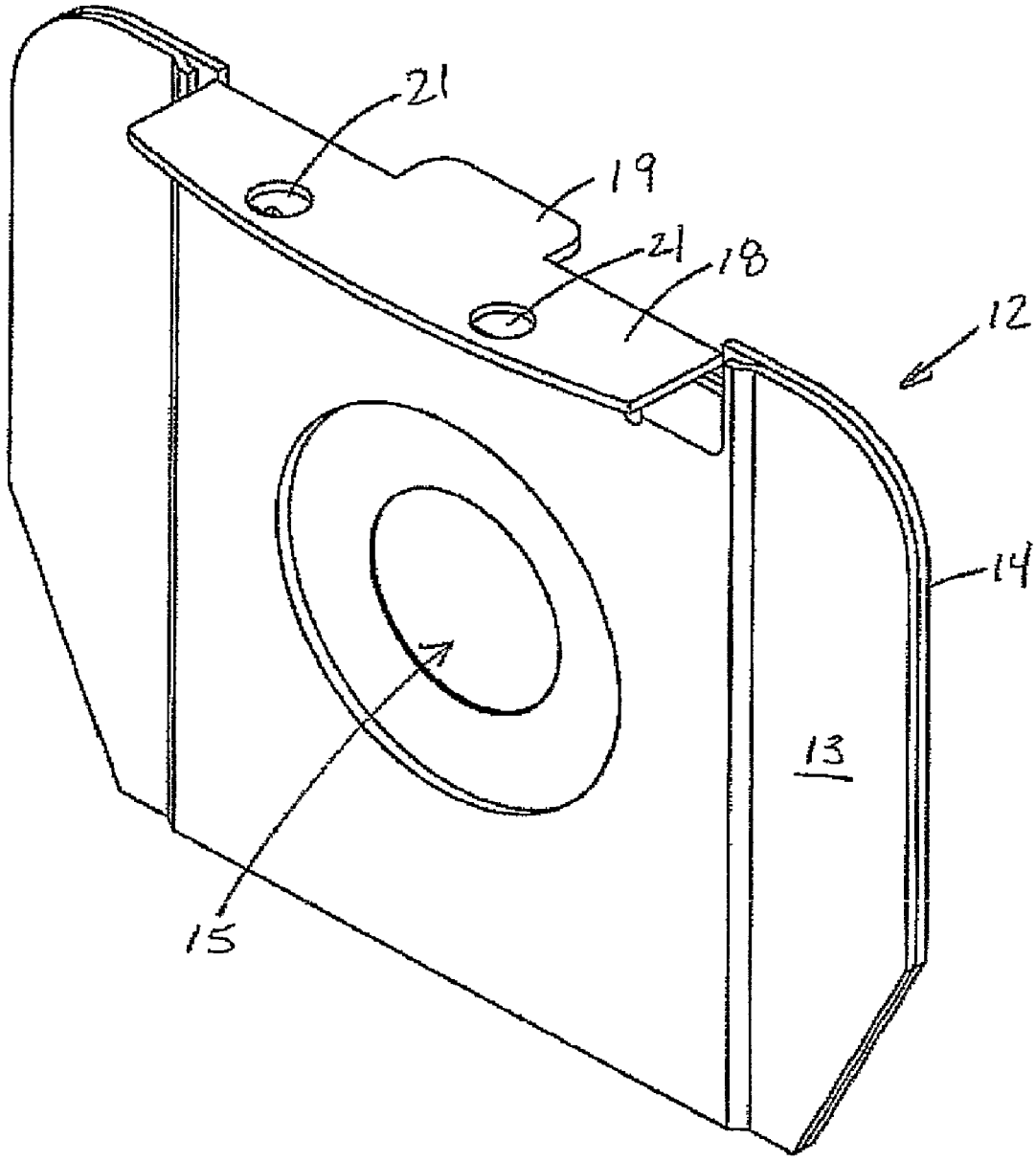
FIG. 2 is a front perspective view of the vacuum bag attachment shown in FIG. 1 wherein a portion the holding plate is shown in a hinged position.
Figure 4:
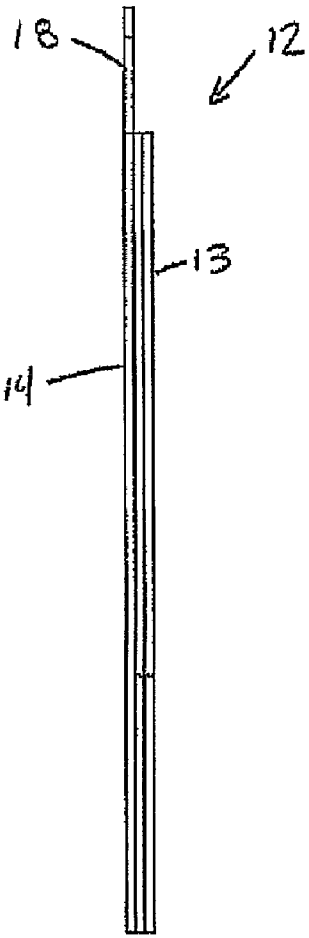
FIG. 4 is a side view of the vacuum bag attachment shown in the position illustrated in FIG. 1.
Figure 3:
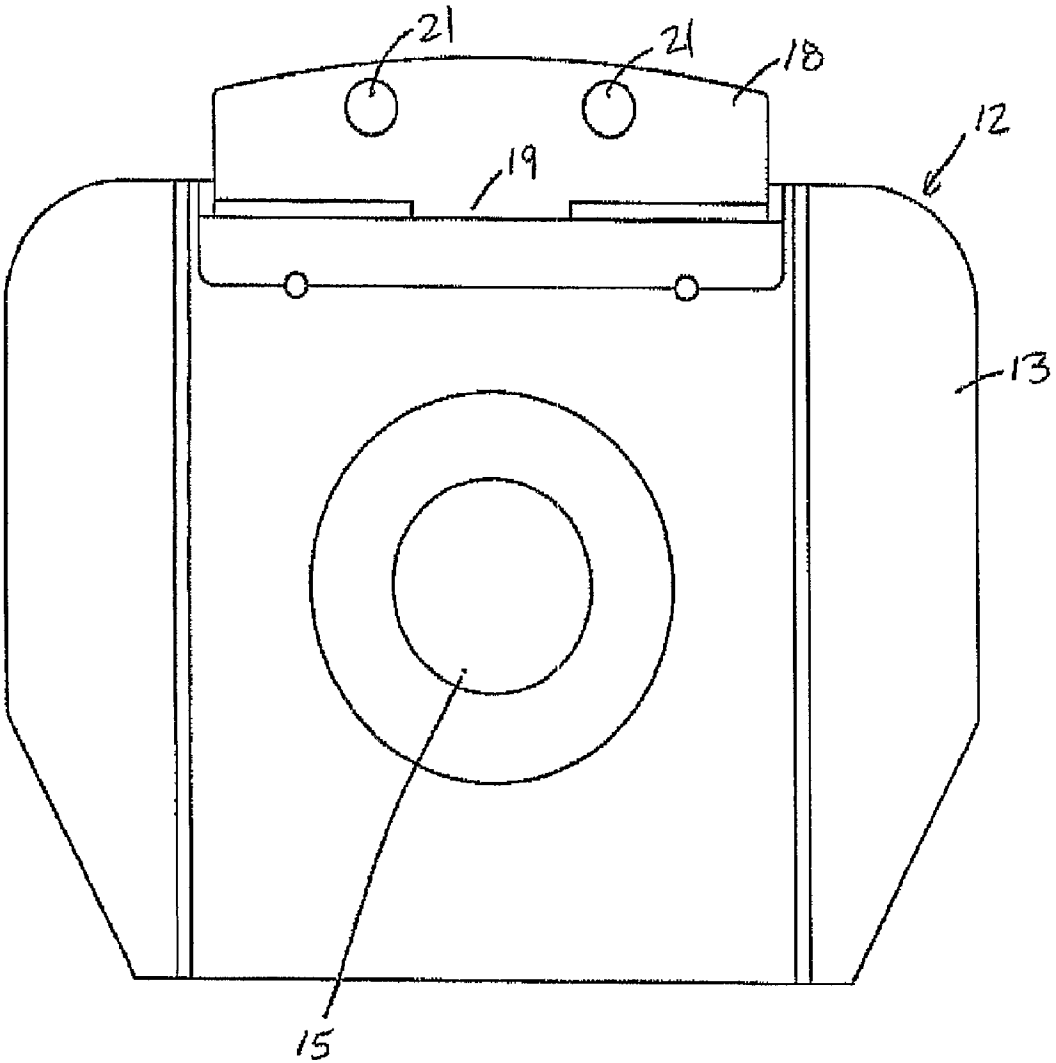
FIG. 3 is a front view of the vacuum bag attachment shown in position illustrated in FIG. 1.

Referring now in detail to the drawings, FIG. 1 shows a perspective view of a vacuum bag 10 of a vacuum cleaner 11. As illustrated, the vacuum bag 10 has a holding plate 12 coupled to the bag 10. With reference to FIGS. 1 and 2, the holding plate has a movable portion 18. As illustrated, the moveable portion 18 of the holding plate 12 is moveable between at least two positions. As described in detail below, this moveable portion 18 can be used to secure the holding plate 12 to a vacuum cleaner 11.

The bag 10 can be constructed several ways. However, in some embodiments, the bag 10 comprises a number of layers of a filter paper that is permeable to air, wherein the filter paper is arranged to form a container or bag for collecting vacuumed debris. In other embodiments, the bag 10 can be constructed from other materials, such as cloth.

The holding plate 12 is coupled to the bag 10 to connect the bag 10 to the vacuum cleaner 11 and form an opening in the bag 10 to allow materials to be deposited in the bag 10 by the vacuum cleaner 11. In one particular embodiment, the holding plate 12 is formed by the two layers 13 and 14 of a relatively dimensionally stable cardboard that are joined together. However, in other embodiments, the holding plate 12 can be constructed from other materials, such as plastics and the like.

The holding plate 12 has an aperture 15 that penetrates the two layers 13 and 14 and defines the opening in the bag 10. When holding plate 12 is in its mounted position (see FIGS. 8 and 11), the aperture 15 is penetrated by a conduit 16 located at a vacuum suction port 17 of the vacuum cleaner 11. Air laden with dirt flows into filter bag 10 via the conduit 16.

The holding plate 12 has a moveable or hinged portion 18 that can be used to secure the holding plate 12 to the conduit 16. As illustrated, the hinged portion 18 is located along the outer periphery holding plate 12. In some embodiments, the hinged portion 18 is integrally formed with the remainder of the holding plate 12. In other embodiments, the hinged portion 18 is part of a separate substructure that is sandwiched between the two layers 13 and 14 of the holding plate 12.

The hinged portion 18 can be provided with a hinge 19 many ways. For example, in some embodiments, portions of the holding plate 12 or separate substructure can be cut or scored to form a hinge 19. In other embodiments, a hinge assembly can be coupled to the holding plate or the separate substructure. As shown in the drawings, the hinged portion is moveable between at least two positions. Specifically, in a first position, the hinged portion 18 is generally parallel with the remainder of the holding plate 12 when not in use. As described in greater detail below, in a second position, this hinged portion 18 is placed at an angle with respect to the remainder of the holding plate 12 to secure the holding plate 12 to the conduit 16 of a vacuum cleaner 11.

Figure 5:
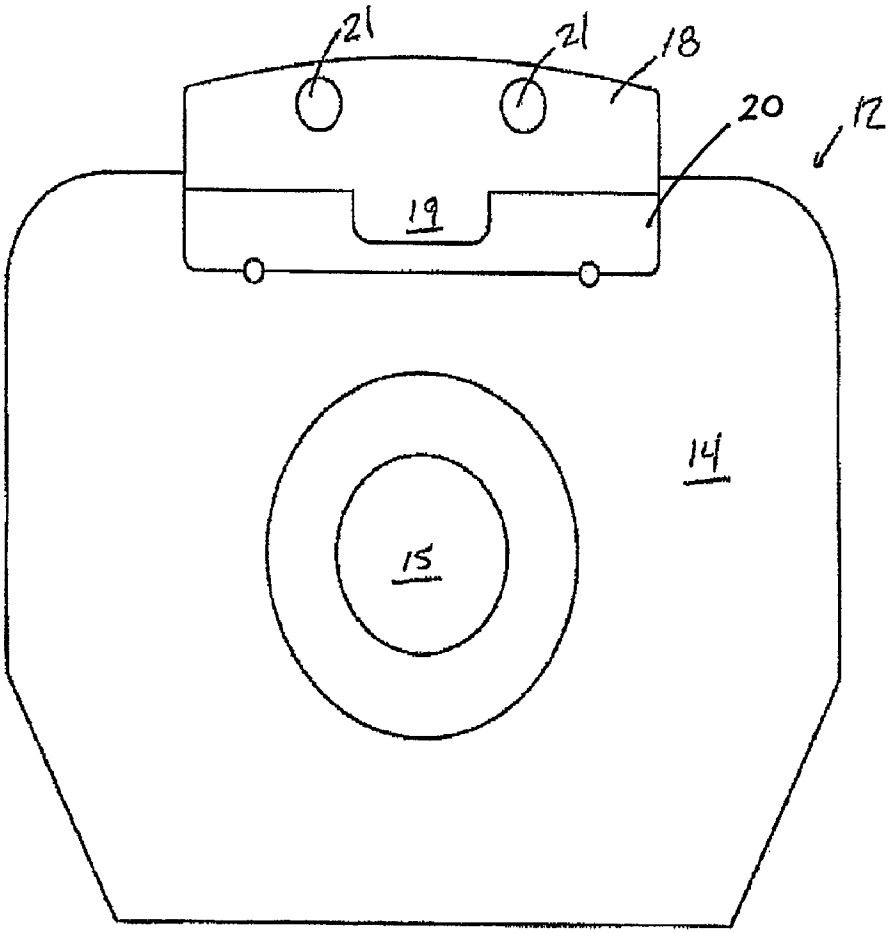
FIG. 5 is a rear view of the vacuum bag attachment shown in the position illustrated in FIG. 1.
Figure 6:
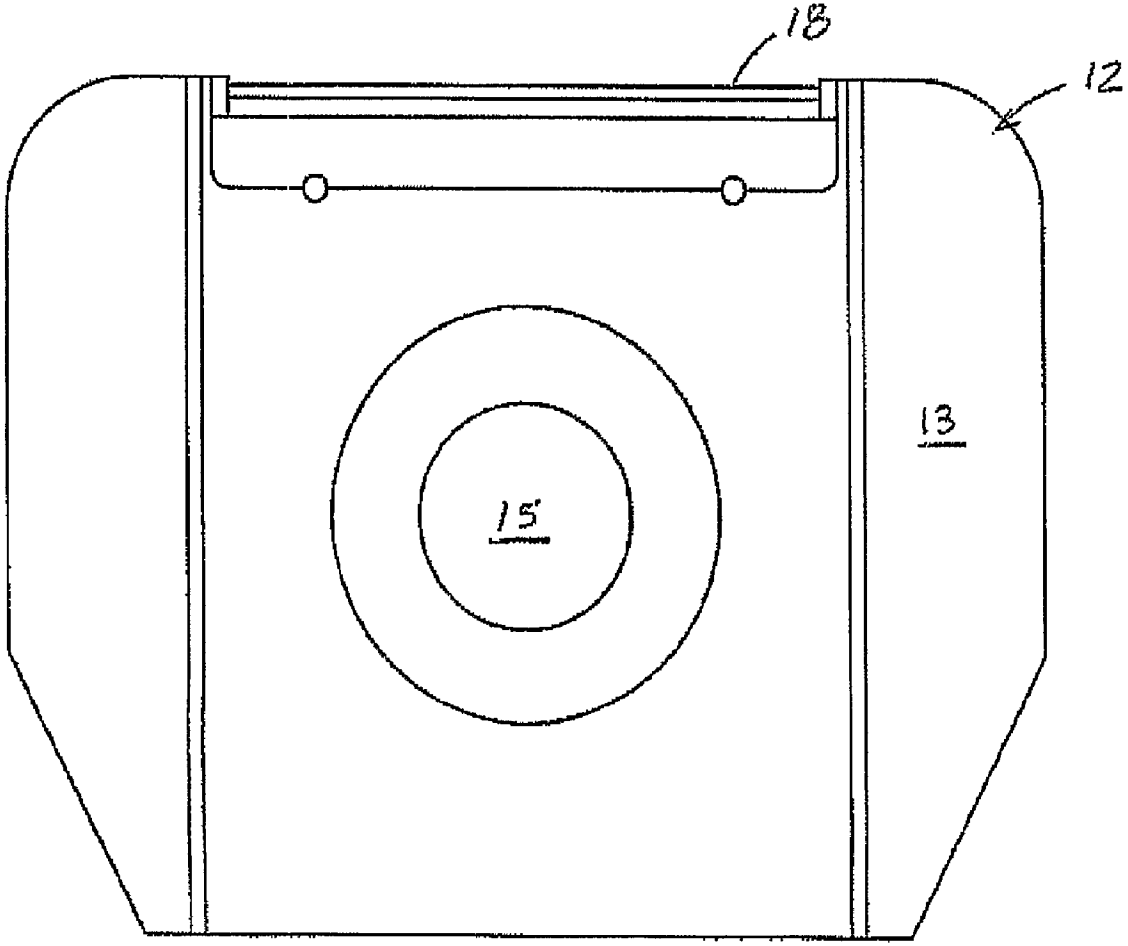
FIG. 6 is a front view of the vacuum bag attachment shown in the position illustrated in FIG. 2.

Some embodiments of the hinged portion 18 can be provided with a member 20 that extends beyond the hinge 19, such as shown in FIGS. 2 and 5 his member 20 can reinforce the hinge 19 to prevent unwanted articulation and/or allow articulation in only one direction.

Figure 8:
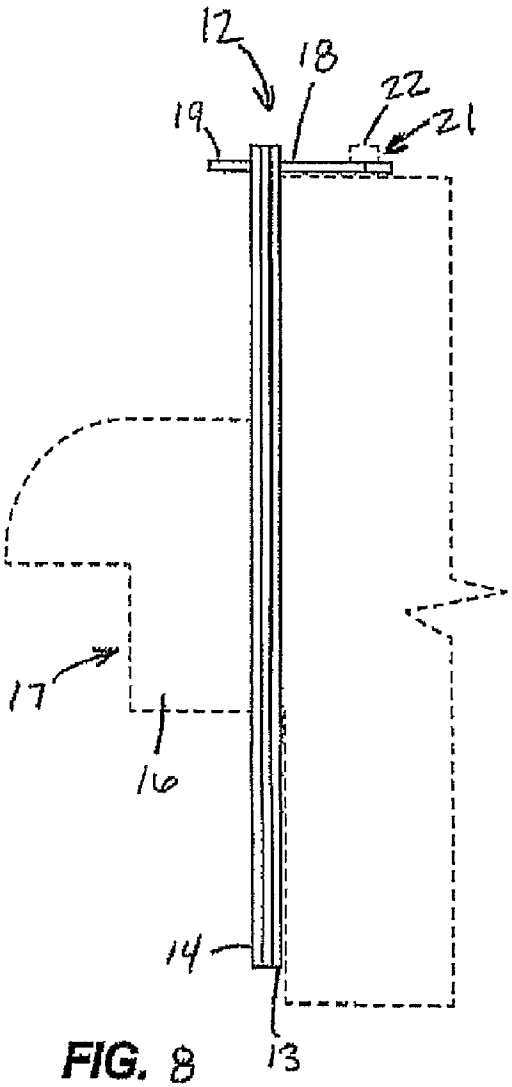
FIG. 8 is a side view of the vacuum bag attachment shown in the position illustrated in FIG. 2 with the vacuum bag attachment being attached to a vacuum port shown in phantom.
Figure 7:
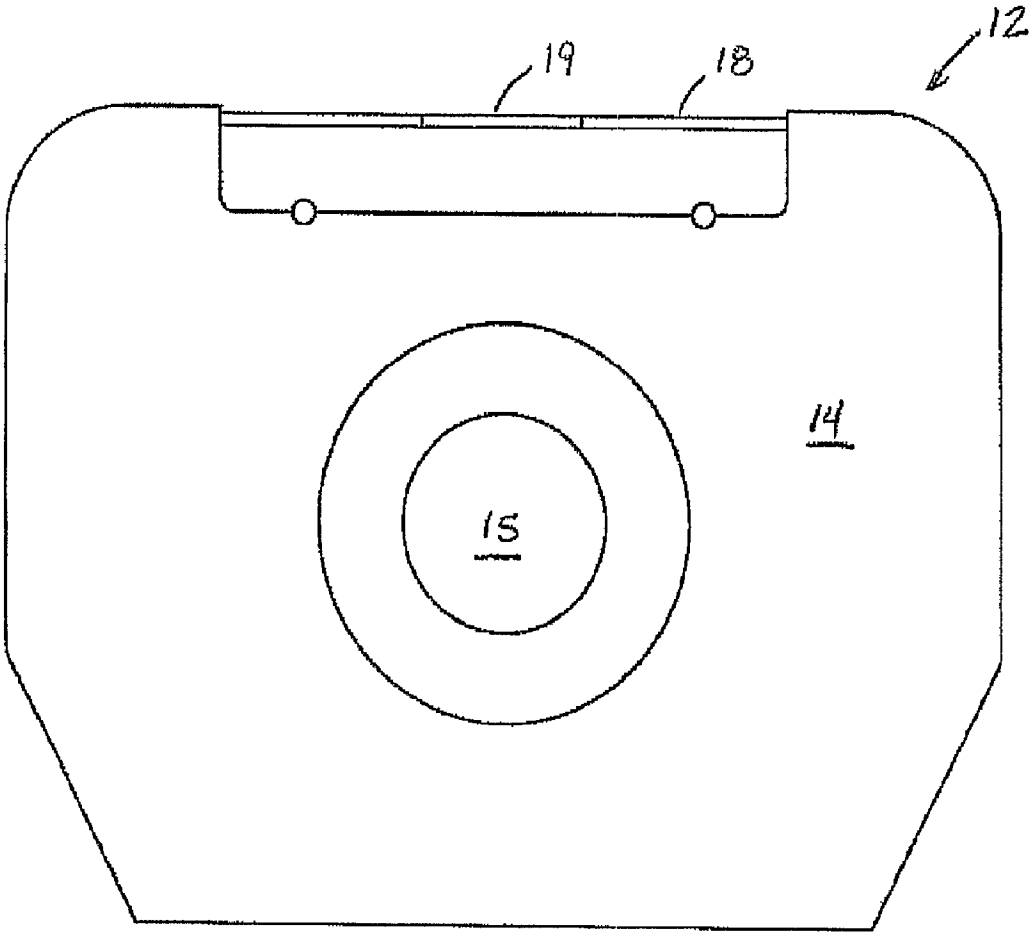
FIG. 7 is a rear view of the vacuum bag attachment shown in the position illustrated in FIG. 2.
Figure 9:
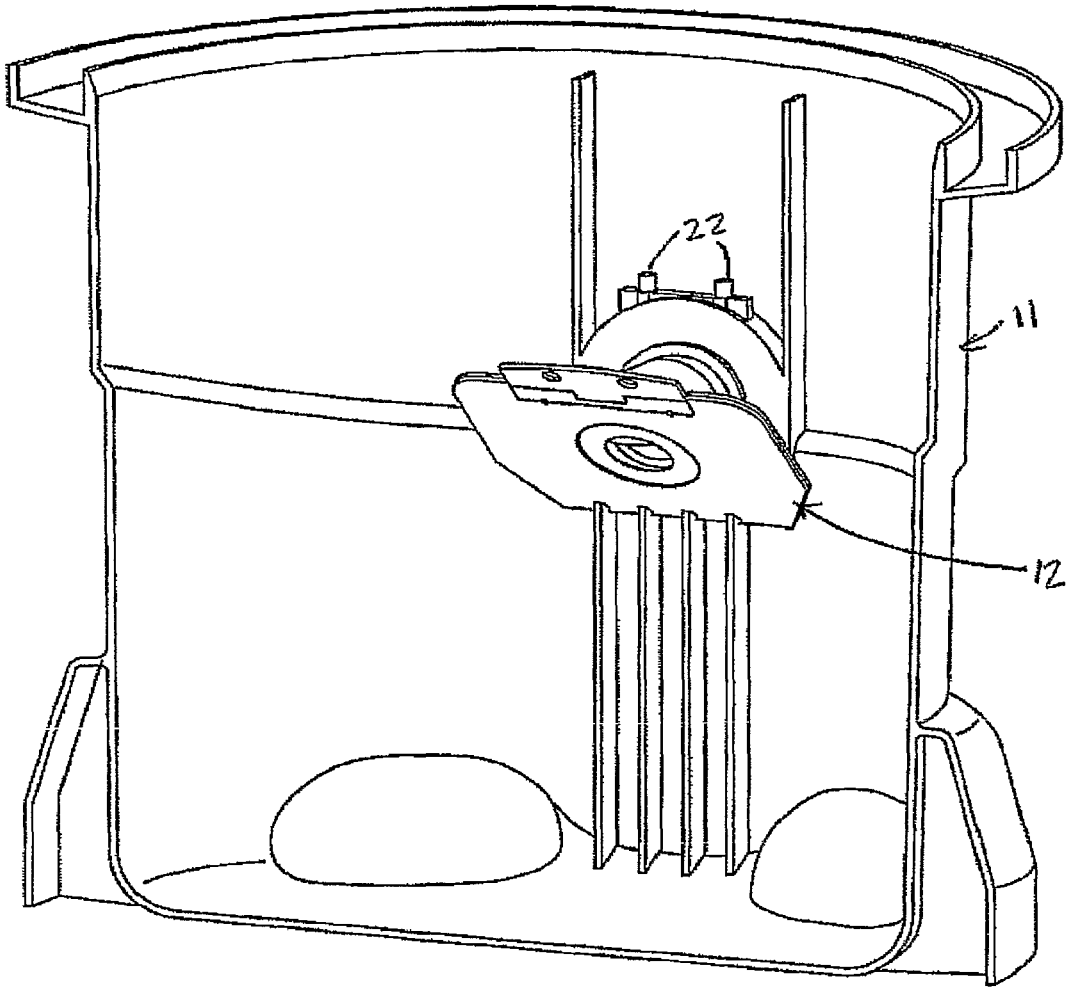
FIG. 9 is a rear perspective view of a vacuum bag attachment shown in FIGS. 1-8, wherein the vacuum bag attachment is shown in relation to a vacuum chamber.
Figure 11:
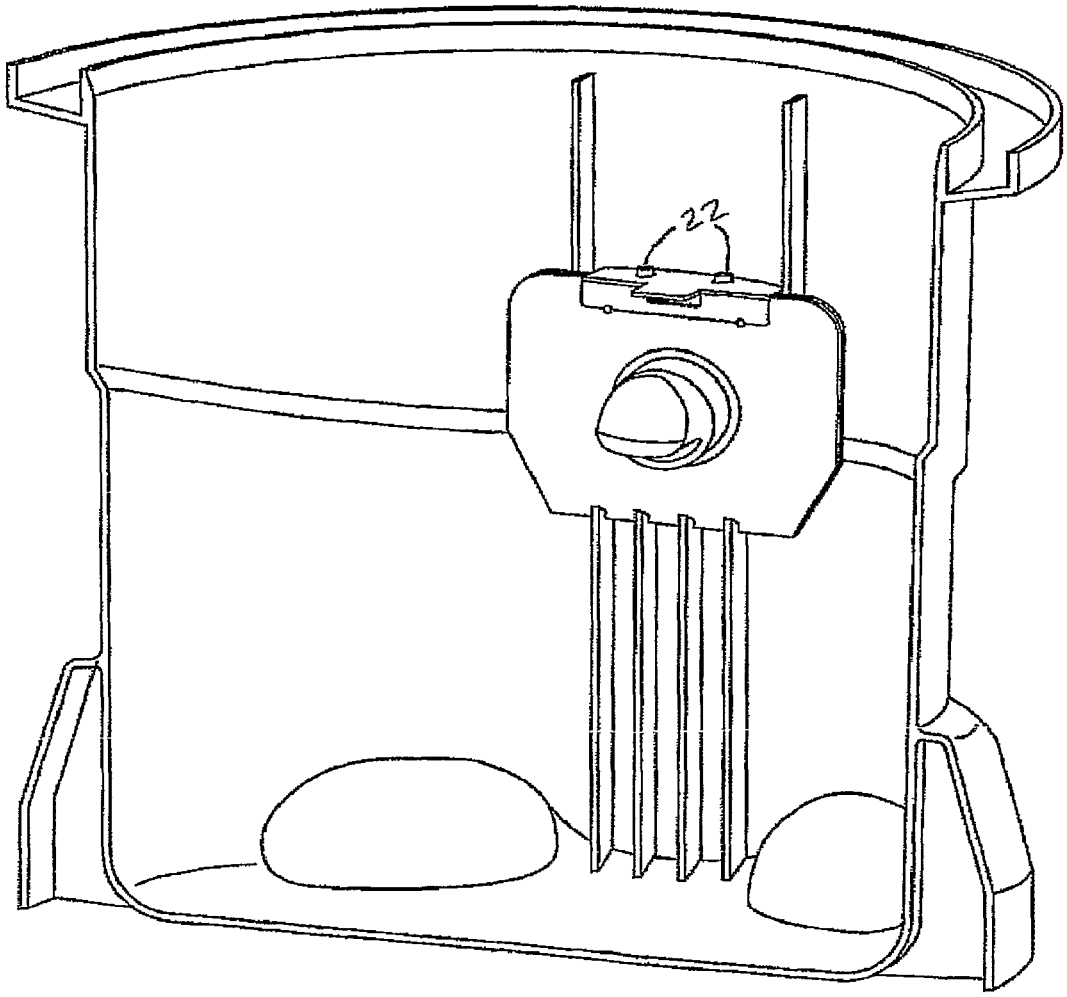
FIG. 11 is a rear perspective view of a vacuum bag attachment shown in FIG. 9, wherein the vacuum bag attachment is shown secured to a vacuum port of the vacuum chamber.

As illustrated, the hinged portion 18 includes a pair of apertures 21. These apertures 21 are located and configured to engage a projecting portion 22 of the vacuum cleaner adjacent the conduit 16 when the hinged portion 18 is placed in a position wherein the hinged portion 18 is substantially normal to the remainder of the holding plate 12. The projecting portion 22 can be configured several different ways. For example, as shown in FIGS. 8, 9, and 11, the projecting portion 22 can include two substantially cylindrical projections having somewhat spherical ends. However, in other embodiments, more or less projections can be used and they can be provided with a different configuration. Preferably, the apertures 21 in the hinged portion 18 of the holding plate 12 are nearly the same size or slightly smaller than the projections 22 to provide an interference fit. However, in other embodiments, the apertures 21 can be larger than the projections 22.

Figure 10:
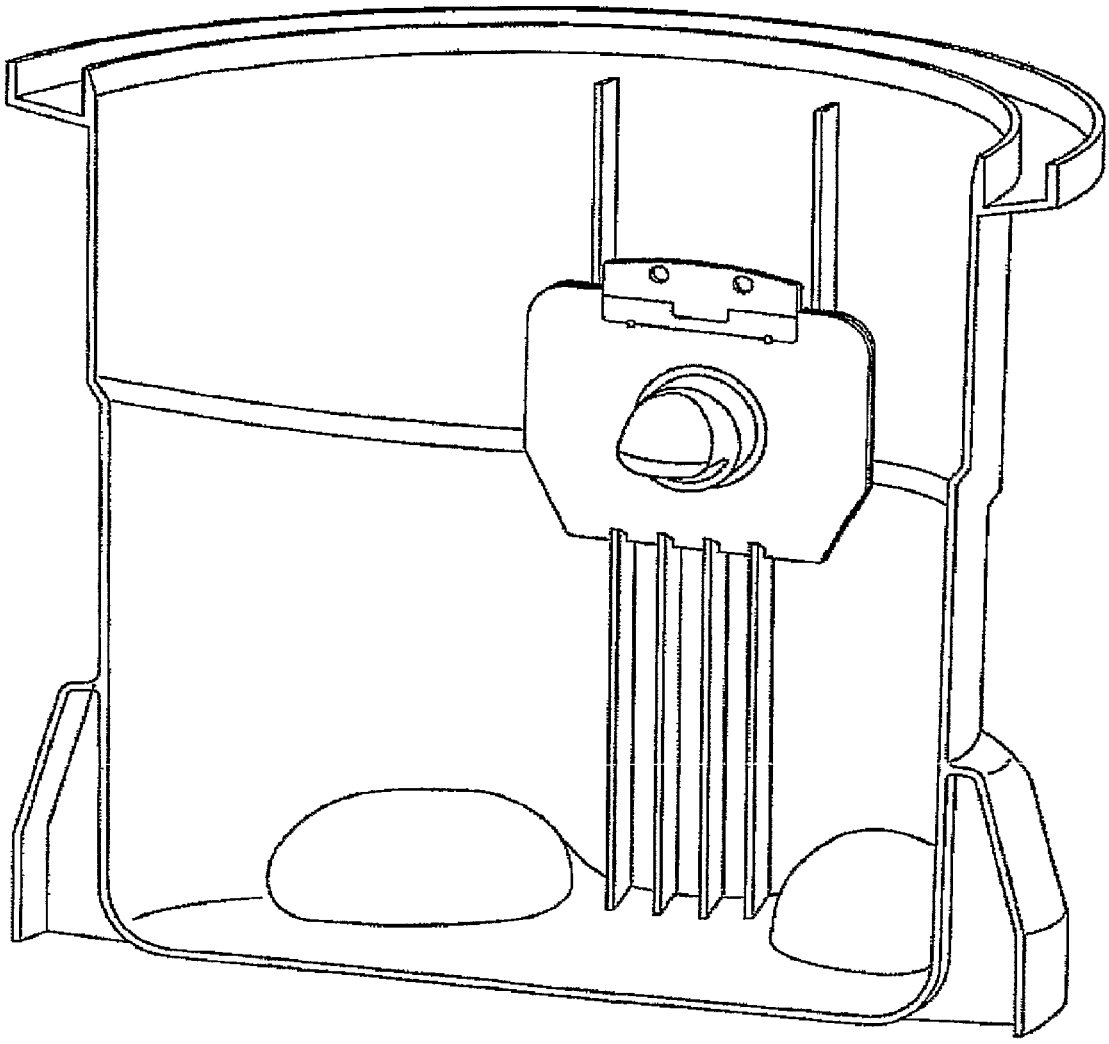
FIG. 10 is a rear perspective view of a vacuum bag attachment shown in FIG. 9, wherein the vacuum bag attachment is shown coupled to a vacuum suction port of the vacuum chamber.

In operation, a vacuum bag 10 having the illustrated holding plate 12 can be coupled to a vacuum cleaner 11 as described below and shown in FIGS. 9-11. First, as shown in FIG. 9, the holding plate 12 is positioned adjacent the conduit 16 of a suction port 17 of the vacuum cleaner 11. The holding plate 12, and more specifically, the aperture 15 in the holding plate 12 for the conduit 16 can be manually aligned with the conduit 16 or it can be automatically aligned by positioning an edge of the holding plate 12 on an alignment device within the vacuum housing, such as the ledge shown in FIGS. 9-11. Once the aperture 15 is aligned with the conduit 16, the holding plate 12 can be pushed toward the conduit 16 to cause the conduit 16 to enter the aperture 15 of the holding plate 12. Once the conduit 16 is positioned in the aperture 15, the hinged portion 18 can be articulated or folded toward the vacuum housing. While the hinged portion 18 is being moved from a position that is substantially parallel to the remainder of the holding plate 12 to a position that is substantially normal to the remainder of the holding plate 12, the apertures 21 in the hinged portion 18 can be placed on the projections 22 extending from or adjacent to the conduit 16 of the suction port. With the projections 22 located within the apertures 21 of the hinged portion 18, the vacuum bag 10 is now secured to the conduit 16.

To remove the vacuum bag 10 from the vacuum cleaner 11, the hinged portion 18 will be pivoted about the hinge 19 to a position wherein the projections 22 are no longer positioned within the apertures 21. Then, the aperture 15 on the holding plate 12 can be removed from the conduit 16.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A vacuum bag attachment device for attaching a vacuum bag to a suction port of a vacuum cleaner having a fixation projection positioned adjacent the suction port, the vacuum bag attachment device comprising a holding plate having a first aperture configured and adapted to be received on the suction port of the vacuum cleaner, the holding plate having a hinged portion with a second aperture positioned within the hinged portion, the second aperture configured and dimensioned to be received on the projection adjacent the suction port of the vacuum cleaner when the hinged portion is positioned substantially normal to the remainder of the holding plate.

2. A vacuuming device, comprising:

a housing defining a chamber;

an opening extending through the housing;

a conduit extending from the opening and into the chamber;

a projection positioned adjacent the conduit and extending in a substantially normal direction relative to the direction of extension of the conduit; and a vacuum bag adapted to be received within the chamber and coupled to the conduit, the vacuum bag having an attachment device for connecting the vacuum bag to the conduit, the attachment device having a flange member or holding plate including a first aperture configured and adapted to be received on the conduit, the flange member having a hinged portion with a second aperture positioned within the hinged portion, the second aperture configured and dimensioned to be received on the projection adjacent the conduit of the vacuum cleaner.

3. A method of attaching a vacuum bag to a vacuum cleaner, the method comprising:

providing a vacuum cleaner having a suction port with a fixation projection positioned adjacent the suction port;

providing a vacuum bag having an attachment device for connecting the vacuum bag to the suction port, the attachment device having a holding plate including a first aperture configured and adapted to be received on the suction port, the holding plate having a hinged portion with a second aperture positioned within the hinged portion, the second aperture configured and dimensioned to be received on a projection adjacent the suction port of the vacuum cleaner;

aligning the first aperture with the suction port;

placing the first aperture around the suction port;

folding the hinged portion of the holding plate toward the suction port; and placing the second aperture around a projection adjacent the suction port.

* * * * *